US009656733B1

(12) United States Patent
Legg

(10) Patent No.: US 9,656,733 B1
(45) Date of Patent: May 23, 2017

(54) LIFE PRESERVER LOCATOR SYSTEM

(71) Applicant: The United States of America, as represented by the Secretary of the Navy, Washington, DC (US)

(72) Inventor: Jeffrey D. Legg, Chula Vista, CA (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 15/137,285

(22) Filed: Apr. 25, 2016

Related U.S. Application Data

(60) Provisional application No. 62/288,769, filed on Jan. 29, 2016.

(51) Int. Cl.
*B63C 9/08* (2006.01)
*B63C 9/20* (2006.01)
*B63C 9/18* (2006.01)

(52) U.S. Cl.
CPC . *B63C 9/20* (2013.01); *B63C 9/18* (2013.01)

(58) Field of Classification Search
CPC .... B63C 9/00; B63C 9/18; B63C 9/20; B63C 9/22; B63C 9/23; B63C 9/26; B63C 2009/00; B63C 2009/26
USPC ..... 441/80, 84, 88, 89
See application file for complete search history.

(56) References Cited

U.S. PATENT DOCUMENTS 6,222,484 B1 * 4/2001 Seiple ..... B63C 9/0005 342/357.55
2012/0122358 A1 * 5/2012 Hansbro ..... A45F 3/20 441/89
2012/0282832 A1 * 11/2012 Hansbro ..... A45F 3/04 441/89

(Continued)

OTHER PUBLICATIONS

Lile, Samantha, Rescue Me Balloon Promises to Save Lives [Video], <http://www.wideopenspaces.com/rescue-balloon-promises-save-lives-video/>, Nov. 30, 2014, pp. 1-4.

(Continued)

*Primary Examiner* — Daniel V Venne
(74) *Attorney, Agent, or Firm* — Naval Postgraduate School; Lisa A. Norris

(57) ABSTRACT

A life preserver locator system for assisting in locating and rescuing persons located in body of water. The life preserver locator system includes a water permeable envelope attachable to a life preserving aid and having a deployable water-activated signal assembly. In one embodiment, the deployable water-activated signal assembly includes a water-activated gas inflator mechanism that on exposure to water, such as saltwater, automatically actuates to inflate a balloon. The balloon deploys from the envelope into the air on a cable attached to the life preserver locator system allowing establishment of a line of sight from a person in the water and a rescue vessel to the balloon. In one embodiment, a light emitting device, such as strobe light, on the balloon automatically activates to emit light, to assist the person in the water in locating the life preserving aid. When the person (Continued)

reaches the life preserving aid, the person can activate a switch on the water-activated signal assembly changing the appearance of the emitted light.

15 Claims, 10 Drawing Sheets

(56) References Cited

U.S. PATENT DOCUMENTS

2014/0210598 A1* 7/2014 Mitchell ..... G06K 7/0008
340/10.5

OTHER PUBLICATIONS

McDonald, Glenn, Rescue Me Balloon Uses Helium, LED Lights,<http://news.discovery.com/tech/gear-and-gadgets/rescue-me-balloon-uses-helium-led-lights-141111.htm>, Nov. 11, 2014, pp. 1-2.

* cited by examiner

LIFE PRESERVER LOCATOR SYSTEM

CROSS-REFERENCE TO RELATED APPLICATIONS

This application claims the benefit of U.S. Provisional Application No. 62/288,769 filed Jan. 29, 2016 which is hereby incorporated in its entirety by reference.

BACKGROUND OF THE INVENTION

1. Field of the Invention

The present invention relates generally to devices that assist in the rescue of persons located in a body of water, such as life preservers and location devices.

2. Description of the Related Art

Current life preserver location aids include dye-markers and flashing beacons which can be activated to assist in locating a person located in a body of water, such as a person who has fallen overboard from a ship. From a rescuing ship's perspective, these are helpful aids given the advantage of the ship's elevation above sea level. However, when the person overboard is in the ocean at sea-level, visibility of both the life preserver and/or dye-marker and flashing beacon is dependent on the sea-state. Line of sight from the person overboard to the life preserver is significantly reduced, if not eliminated, given a rough sea state.

SUMMARY OF THE INVENTION

Embodiments in accordance with the invention include a system and method for assisting in locating and rescuing persons fallen overboard into a body of water, such as an ocean. In accordance with one embodiment, a life preserver locator system includes: a water permeable envelope having a plurality of water permeable flaps and an interior space; one or more straps, each of the one or more straps attached at a first end to the water permeable envelope; one or more connectors, each of the one or more connectors attached to a second end of each of the one or more straps; and a water-activated signal assembly enclosed in the interior space of the water permeable envelope and attached to the water permeable envelope, wherein the water-activated signal assembly is deployable from the interior space when activated by contact with water. The water permeable envelope further includes a supporting rim, wherein each of the plurality of water permeable flaps is moveably connected to the supporting rim.

In one embodiment, the water-activated signal assembly includes: a waterproof switch attached to the water permeable envelope; a cable attached at a proximal end to the waterproof switch; a wire conductively attached at a proximal end to the waterproof switch; a water-activated gas inflator mechanism including a gas inflation cartridge, attached to a distal end of the cable; an inflatable balloon having an inflation opening, the inflation opening attached to the gas inflator mechanism; and a strobe light attached to the water-activated gas inflator mechanism, the strobe light further attached to a proximal end of the wire.

In accordance with one embodiment, a method for deploying a life preserver locator system includes: attaching a life preserver locator system to a floatable life preserving aid, the life preserver locator system including: a water permeable envelope having a plurality of water permeable flaps and an interior space; one or more straps, each of the one or more straps attached at a first end to the water permeable envelope; one or more connectors, each of the one or more connectors attached to a second end of each of the one or more straps; and a water-activated signal assembly enclosed in the interior space of the water permeable envelope and attached to the water permeable envelope, the water-activated signal assembly including: a waterproof switch attached to the water permeable envelope; a cable attached at a proximal end to the waterproof switch; a wire conductively attached at a proximal end to the waterproof switch; a water-activated gas inflator mechanism including a gas inflation cartridge, attached to a distal end of the cable; an inflatable balloon having an inflation opening, the inflation opening attached to the water-activated gas inflator mechanism; and a strobe light attached to the water-activated gas inflator mechanism, the strobe light further conductively attached to a proximal end of the wire; deploying the life preserver locator system on the floatable life preserving aid into a body of water; automatically activating the water-activated gas inflator mechanism on contact with the water; automatically inflating the inflatable balloon by the water-activated gas inflator mechanism with gas from the gas inflation cartridge; automatically activating the strobe light to emit a first light type; and automatically deploying the balloon into the air from the water permeable envelope such that the balloon is suspended in the air and attached to the life preserver locator system by the cable. In one embodiment, upon activation of the waterproof switch, such as by a person located in the water, a signal is sent from the waterproof switch over the wire to the strobe light changing the appearance of the emitted light from the first light type to a second light type.

Embodiments in accordance with the invention are best understood by reference to the following detailed description when read in conjunction with the accompanying drawings.

Embodiments in accordance with the invention are further described herein with reference to the drawings.

DETAILED DESCRIPTION OF THE INVENTION

Figure 1A:
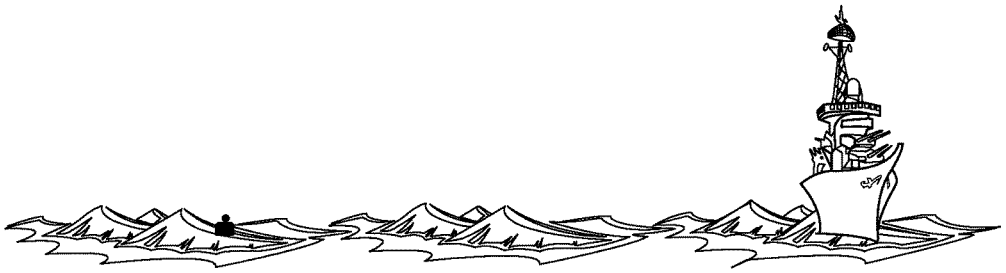
FIGS. 1A-1C illustrate location issues associated with rescue at sea of a person located in a body of water, such as the ocean.
Figure 1B:
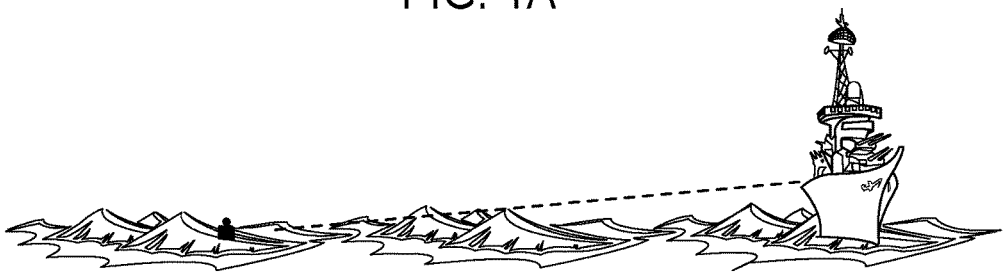
Figure 1C:
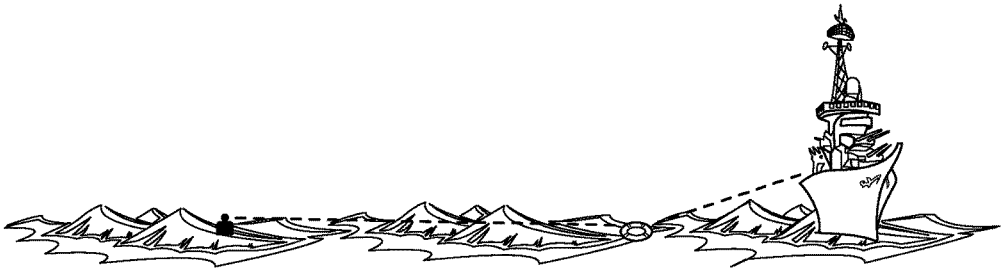
Figure 2:
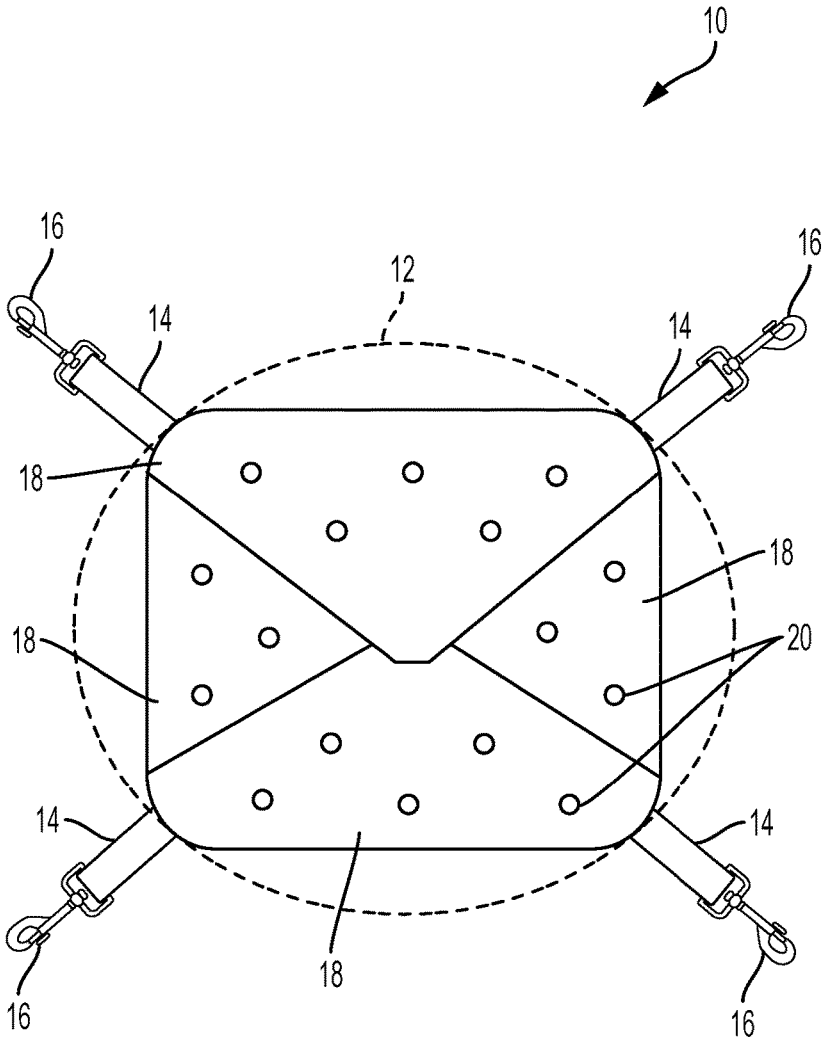
FIG. 2 illustrates a closed top view of a life preserver locator system with envelope flaps closed and with a water-activated signal assembly installed but not shown in accordance with one embodiment of the invention.
Figure 3:
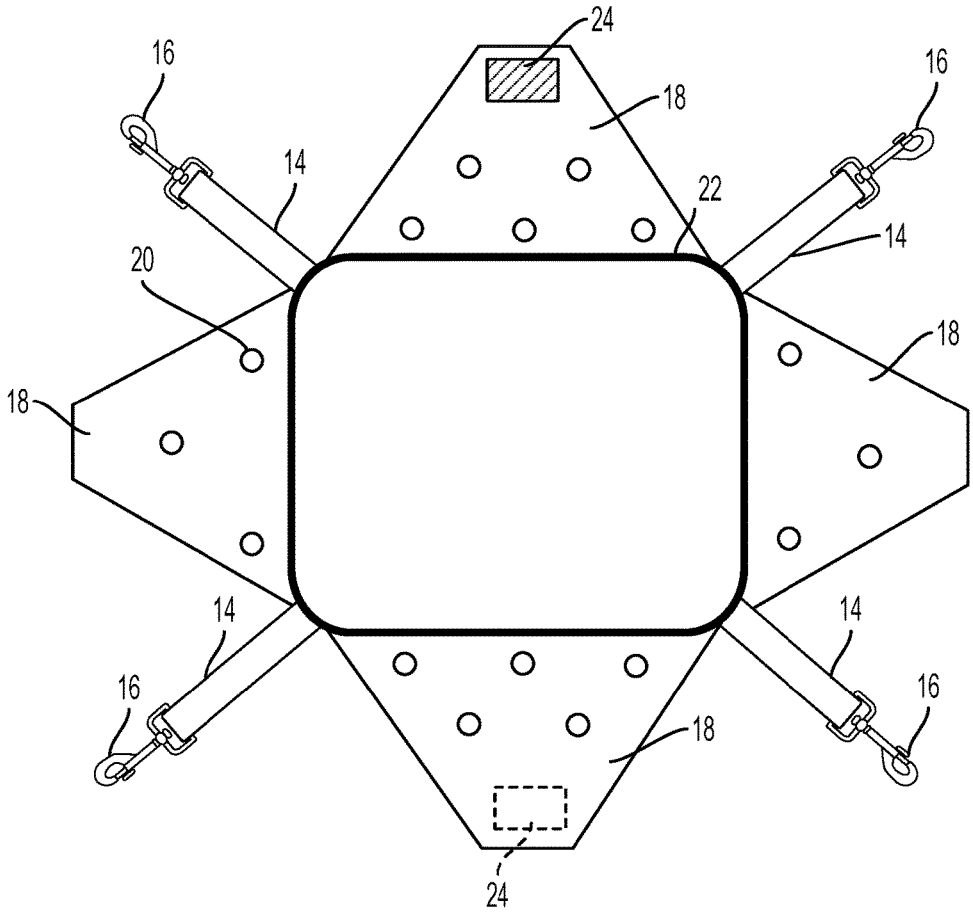
FIG. 3 illustrates an open top view of the life preserver locator system of FIG. 2 with envelope flaps open with the water-activated signal assembly removed in accordance with one embodiment of the invention.
Figure 4:
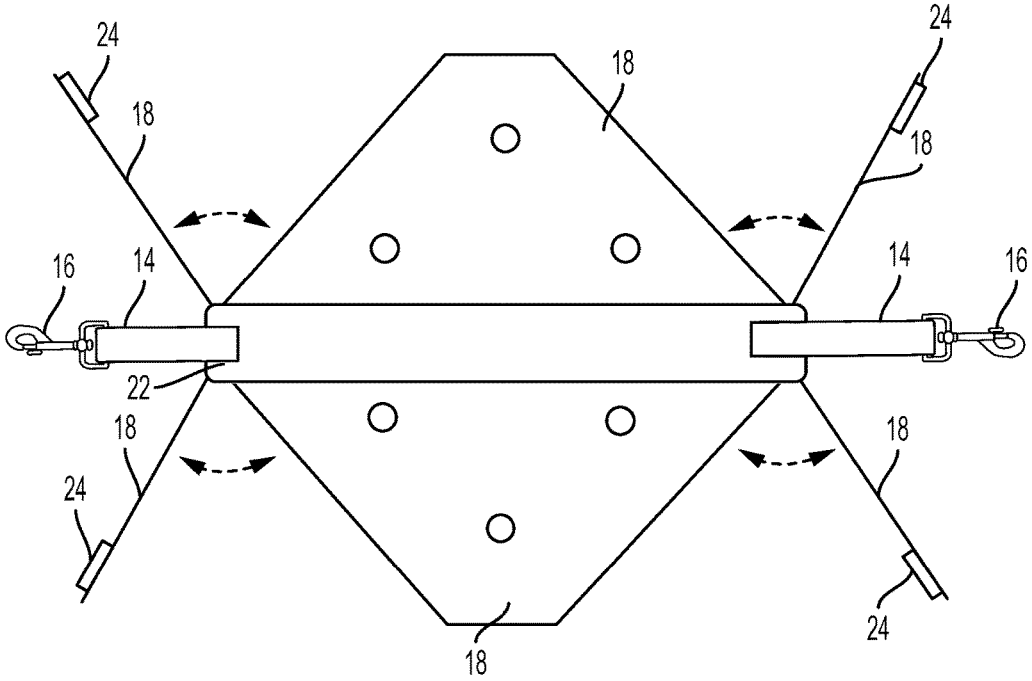
FIG. 4 illustrates an open side view of the life preserver locator system of FIG. 2 with the water-activated signal assembly removed in accordance with one embodiment of the invention.
Figure 5:
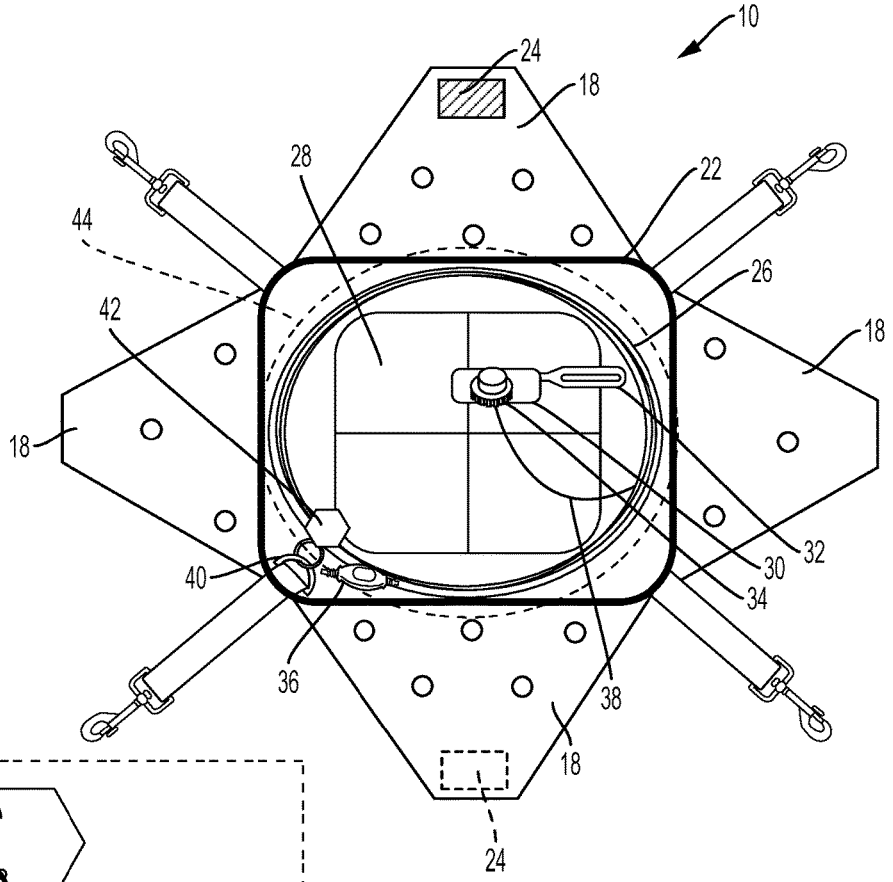
FIG. 5 illustrates an open top view of the life preserver locator system of FIG. 2 with all envelope flaps open and with an unactuated water-activated signal assembly installed in accordance with one embodiment of the invention.
Figure 6:
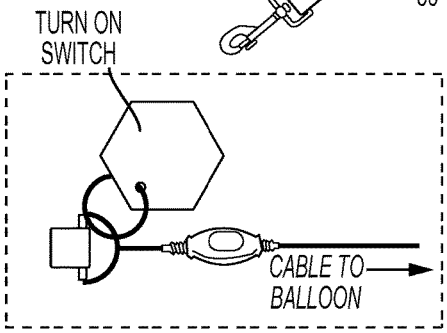
FIG. 6 illustrates an enlarged view of a ring, tag, and switch assembly of the life preserver locator system of FIG. 5 in accordance with one embodiment.
Figure 7A:
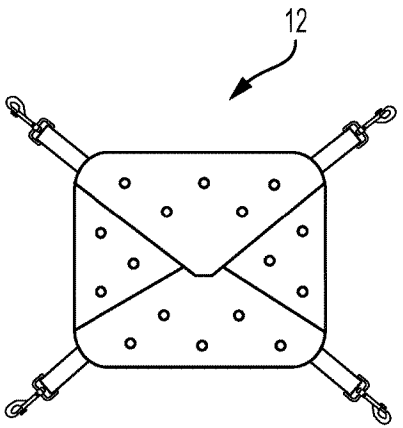
FIGS. 7A-7F illustrate individual components of the life preserver locator system of FIG. 5 in accordance with one embodiment of the invention.
Figure 7B:
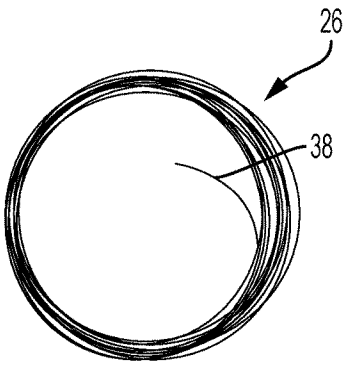
Figure 7C:
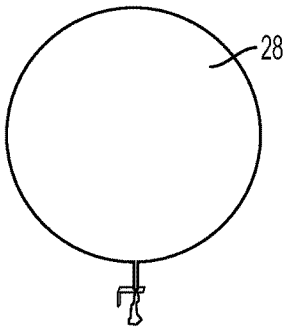
Figure 7D:
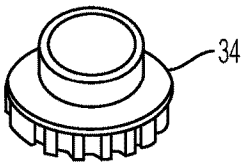
Figure 7E:
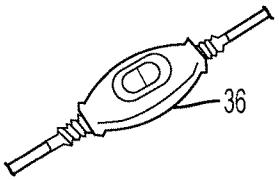
Figure 7F:
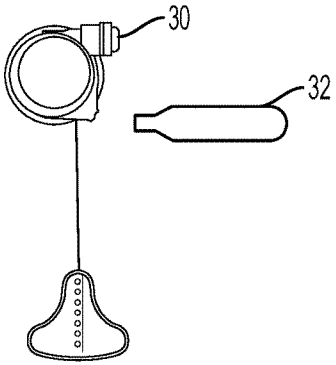

As illustrated in FIGS. 1A-1C, when a person falls overboard from a ship, constant visual contact provides the greatest probability for a successful recovery. However, sea-state, currents, weather, distance, and ship maneuvering all work against this. Even with existing life-assisting aids, such as a life preserver, dye marker, and/or flashing beacon, constant visual contact proves difficult. Simply throwing a life preserver aid, such as a life preserver ring, overboard may not improve the odds of rescuing a person overboard if the person cannot locate the life preserver ring once in the water.

Embodiments in accordance with the invention include a life preserver locator system for assisting in locating and rescuing persons fallen overboard into a body of water, such as an ocean. In one embodiment, the life preserver locator system is automatically activated on exposure to saltwater and can be added to an existing life preserver ring, or other life preserving aid, to assist in the location and rescue of persons located in a body of water, such as an ocean.

Referring now to FIGS. 2-8 together, in one embodiment, a life preserver locator system 10 includes a water permeable envelope 12 enclosing a deployable water-activated signal assembly 44 (see FIGS. 5, 6 and 7B-7F). In one embodiment, one or more straps 14 are attached to envelope 12. Each of one or more straps 14 are connected at proximal ends to envelope 12 and at distal ends to individual connectors 16. Straps 14 can be formed of various materials, for example nylon. Connectors 16 can be various types of connectors suitable for attaching envelope 12 to a specified type of life preserver device. In one embodiment, connectors 16 are bolt snaps which allow envelope 12 to be removably attached to a floatable life preserver ring, such as floatable life preserver ring 46 (see FIG. 8). In one embodiment, envelope 12 is formed of a water permeable material, such as a perforated natural or synthetic rubber, although other water permeable materials can be used.

In the present embodiment, envelope 12 is formed of a plurality of foldable water permeable flaps 18 attached to a supporting rim 22, such as a nylon rim. In one embodiment, each of flaps 18 are formed of a flexible material perforated with a plurality of perforations 20 to allow water into an interior space of envelope 12. In one embodiment envelope 12 includes eight perforated water permeable flaps 18 with four perforated water permeable flaps 18 on a top side (a first side) and four perforated water permeable flaps 18 on a bottom side (a second side). With flaps 18 on each side of envelope 12, a life preserver ring including life preserver locator system 10 can be thrown on either side into the water. When envelope 12 is closed, flaps 18 fold down on each side to form the interior space in which water-activated signal assembly 44 is enclosed. In one embodiment, supporting rim 22 is a closed supporting rim structure having a height and perimeter needed to completely enclose water-activated signal assembly 44 within envelope 12. In one embodiment, each of flaps 18 and each of straps 14 are connected to supporting rim 22. In one embodiment, life preserver locator system 10 is sized to fit onto a standard issue life preserver ring.

As earlier described, in one embodiment, each flap 18 includes perforations 20 to allow water, e.g., saltwater, to enter the interior space of envelope 12. In the present embodiment, envelope 12 includes quick open fasteners 24, such as mated Velcro patches, to fasten two or more flaps 18 on each side of envelope 12. For example, in one embodiment, each side of envelope 12 is closed by placing inward and down two opposite flaps 18 not having fasteners 24, e.g., Velcro patches, and then overlaying the remaining opposite flaps 18 such that the fasteners 24 attach to each other. On activation of water-activated signal assembly 44 stored in the interior space of envelope 12, flaps 18 open out allowing rapid deployment of water-activated signal assembly 44.

Referring more particularly to FIGS. 5, 6 and 7A-7F, in one embodiment, water-activated signal assembly 44 includes: a cable 26 having a conductive wire 38, an inflatable balloon 28, a strobe light 34, a waterproof switch 36 and a water-activated gas inflator mechanism 30 including a gas inflation cartridge 32. In one embodiment, cable 26 is of a length sufficient to allow establishment of a line of sight from both a person located in the water and a ship to balloon 28 when balloon 28 is deployed into the air, for example a length of 60 feet. As can be recognized by those of skill in the art, in various embodiments, the length of cable 26 can be longer or shorter than the example of 60 feet. In one embodiment, balloon 28 is an industrial-grade inflatable balloon. In one embodiment, strobe light 34 is a multi-colored light emitting diode (LED) device with strobe effect. In one embodiment, water-activated gas inflator mechanism 30 is a water-activated helium gas inflator mechanism including a helium gas inflation cartridge 32. In one embodiment, water-activated gas inflator mechanism 30 is saltwater activated. In one embodiment, an instructional tag 42 is attached near switch 36, for example by a D-ring 40 which further connects switch 36 to envelope 12. In one embodiment tag 42 is colored and/or luminous to allow a user to locate tag 42. In one embodiment, tag 42 includes instructions for the user to turn on switch 36 which activates strobe light 34.

Figure 8:
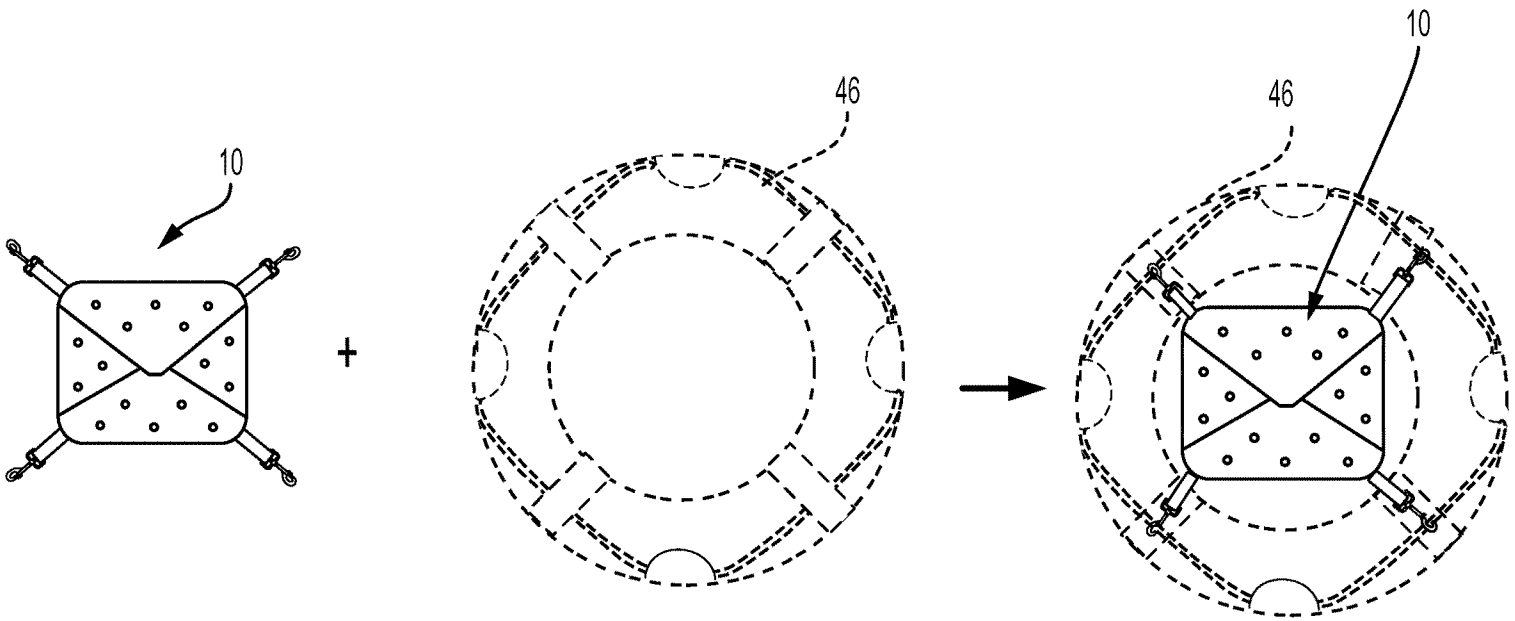
FIG. 8 illustrates a top view of the life preserver locator system of FIG. 2 attached to a floatable life preserver ring in accordance with one embodiment of the invention.

In one embodiment, when unactuated, balloon 28 is uninflated and folded in the interior space of envelope 12. Balloon 28 has an opening to allow inflation which is connected to gas inflator mechanism 30. A distal end, i.e., a first end, of cable 26 is connected to gas inflator mechanism 30 and a proximal end, i.e., a second end, of cable 26 is connected to a first end of switch 36. In one embodiment, wire 38 is also connected to switch 36 at a first end and to strobe light 34 at a second end to allow activation signals to be sent from switch 36 to strobe light 34. In one embodiment strobe light 34 is also connected to gas inflator mechanism 30. A second end of switch 36 is connected to envelope 12. In one embodiment, the second end of switch 36 is connected by a cable to D-ring 40 which is further connected to one end of a strap 14 attached to envelope 12 (see FIGS. 5 and 6). In one embodiment, cable 26 and wire 38 are corrosion resistant. FIG. 8 illustrates a top view of the life preserver locator system 10 attached to floatable life preserver ring 46 in accordance with one embodiment of the invention.

Figure 9A:
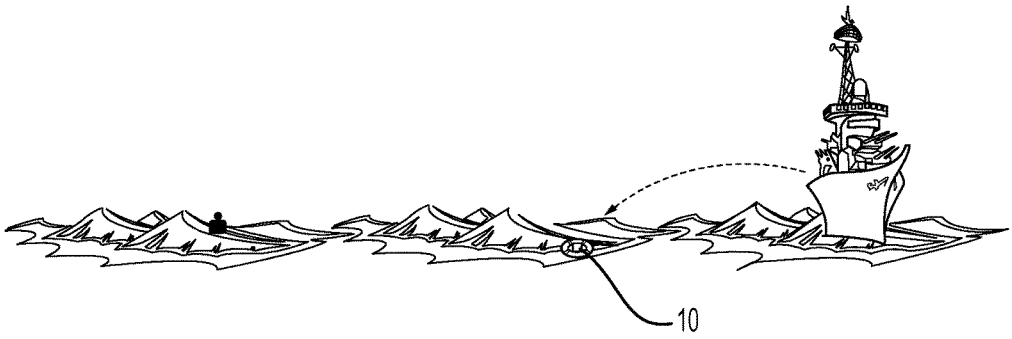
FIGS. 9A-9E illustrate deployment and use of the life preserver locator system of FIG. 2-8 in an ocean rescue example in accordance with one embodiment of the invention.

FIGS. 9A-9E illustrate a method of use of life preserver locator system 10. FIG. 9A illustrates a person overboard scenario in which a person is located in an ocean and life preserver locator system 10 attached to a floatable life preserver ring 46 (see FIG. 8) has been thrown into the ocean, i.e., saltwater, toward the person. When the saltwater enters the interior space of envelope 12 through perforations 20, contact with the saltwater activates water-activated gas inflator mechanism 30, e.g., a saltwater-activated helium gas inflator mechanism, causing helium gas to be dispensed from gas inflation cartridge 32, e.g., a helium gas inflation cartridge, into balloon 28. The helium gas inflates balloon 28 causing balloon 28 to expand and place pressure on fasteners 24. When enough pressure is placed on fasteners 24, fasteners 24 release allowing balloon 28 to deploy from the interior space of envelope 12 and rise up into the air on cable 26. In one embodiment, the activation of gas inflator mechanism 30 also activates strobe light 34. In one embodiment, strobe light 34 emits a first light type, such as a first strobe pattern and/or colored light, for example a yellow light (illustrated in a starred pattern in FIGS. 9B-9D). In another embodiment, strobe light 34 is automatically activated upon exposure to saltwater.

Figure 9B:
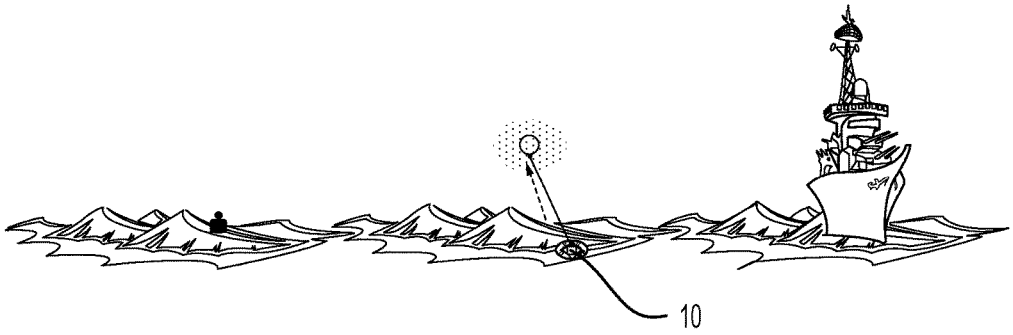
Figure 9C:
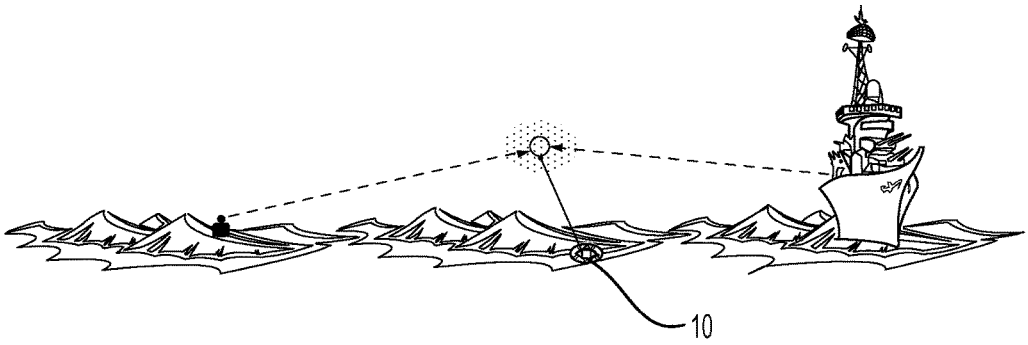
Figure 9D:
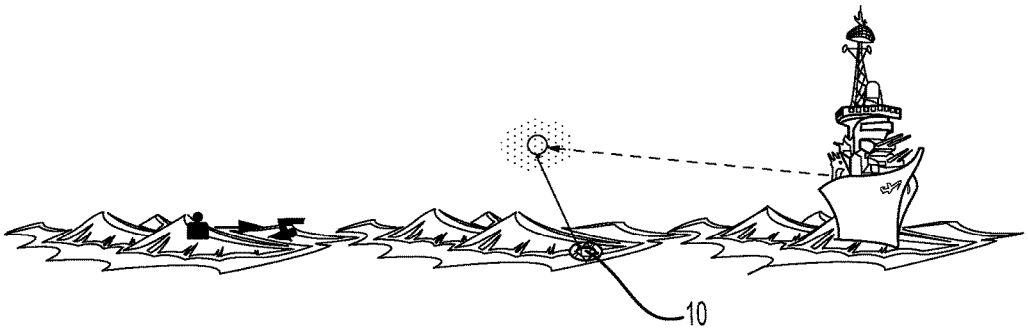

As illustrated in FIG. 9B, by elevating strobe light 34 in the air on balloon 28, for example 60 feet in the air, the line of sight for both the ship and person in the ocean are improved, providing a common point of reference. In FIGS. 9C and 9D, with balloon 28 and strobe light 34 in sight, the person in the ocean can attempt to reach the life preserver ring attached to life preserver locator system 10. Further, with balloon 28 and strobe light 34 in sight, the ship can continue to maneuver as necessary for a rescue attempt.

Figure 9E:
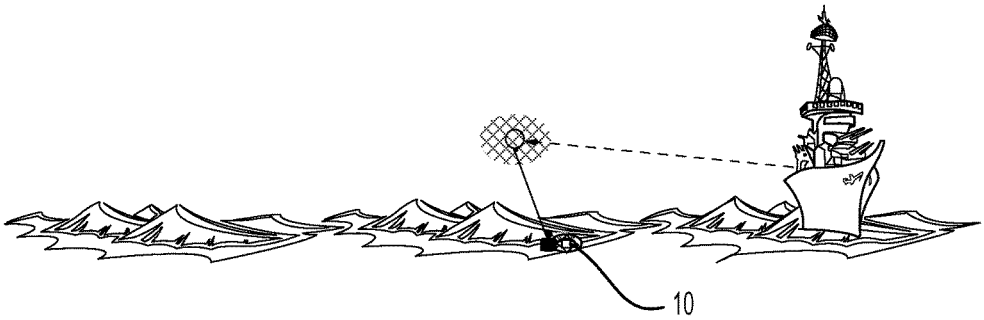

In FIG. 9E, once the person in the ocean reaches the life ring with life preserver locator system 10, the person can activate switch 36, changing the first light type emitted by strobe light 34 to a second light type, such as a second strobe pattern and/or colored light, for example to a green light (illustrated in a grid pattern in FIG. 9E), indicating to the rescue ship, the person has reached the life preserver ring. The rescue ship can then utilize the light emitted from strobe light 34 to maneuver to the location of the person and commence rescue. Those of skill in the art can recognize that although balloon 28 is shown in FIGS. 9B-9E as spherical, other shapes of balloon 28 can be utilized dependent upon the atmospheric conditions to optimize the loft and visibility of balloon 28.

Those of skill in the art can recognize that fewer or more flaps can be utilized, different cable and wire lengths can be used, and light emitting devices different from a strobe light can be used. Further, strobe patterns and/or colors emitted from the strobe light can be different than those described herein. Also different gas inflator mechanisms and gases may be used, for example, hydrogen inflator mechanisms which utilize hydrogen gas. Additionally, in some situations it may be desirable to activate the life preserver system to allow the balloon to inflate and rise prior to deploying the system overboard into the water. In other embodiments, the system can be modified for activation and use in brackish or fresh water situations.

This disclosure provides exemplary embodiments of the present invention. The scope of the present invention is not limited by these exemplary embodiments. Numerous variations, whether explicitly provided for by the specification or implied by the specification or not, may be implemented by one of skill in the art in view of this disclosure.

What is claimed is:

1. A life preserver locator system comprising:

a water permeable envelope having a plurality of water permeable flaps and an interior space;

one or more straps, each of the one or more straps attached at a first end to the water permeable envelope;

one or more connectors, each of the one or more connectors attached to a second end of each of the one or more straps; and a water-activated signal assembly enclosed in the interior space of the water permeable envelope and attached to the water permeable envelope, wherein the water-activated signal assembly is deployable from the interior space when activated by contact with water.

2. The system of claim 1 wherein the water permeable envelope further comprises:

a supporting rim; and wherein each of the plurality of water permeable flaps is moveably connected to the supporting rim.

3. The system of claim 2 wherein each of the water permeable flaps include one or more perforations to allow water into the interior space of the water permeable envelope.

4. The system of claim 1 wherein the water-activated signal assembly comprises:

a waterproof switch attached to the water permeable envelope;

a cable attached at a proximal end to the waterproof switch;

a wire conductively attached at a proximal end to the waterproof switch;

a water-activated gas inflator mechanism including a gas inflation cartridge, attached to a distal end of the cable;

an inflatable balloon having an inflation opening, the inflation opening attached to the water-activated gas inflator mechanism; and a strobe light attached to the water-activated gas inflator mechanism, the strobe light further attached to a proximal end of the wire.

5. The system of claim 4 wherein the inflatable balloon is an industrial-grade inflatable balloon.

6. The system of claim 4 wherein the water-activated gas inflator mechanism is saltwater activated.

7. The system of claim 4 wherein the gas inflation cartridge is a helium gas inflation cartridge.

8. The system of claim 4 wherein the strobe light is a multi-colored LED with strobe effect.

9. The system of claim 4, wherein the strobe light is automatically activated upon activation of the water-activated gas inflator mechanism and emits light of a first light type.

10. The system of claim 9, wherein upon activation of the waterproof switch, a signal is sent from the waterproof switch to the strobe light changing the appearance of the emitted light from the first light type to a second light type.

11. A method for deploying a life preserver locator system comprising:

attaching a life preserver locator system to a floatable life preserving aid, the life preserver locator system comprising:

a water permeable envelope having a plurality of water permeable flaps and an interior space;

one or more straps, each of the one or more straps attached at a first end to the water permeable envelope;

one or more connectors, each of the one or more connectors attached to a second end of each of the one or more straps; and a water-activated signal assembly enclosed in the interior space of the water permeable envelope and attached to the water permeable envelope, the water-activated signal assembly comprising:

a waterproof switch attached to the water permeable envelope;

a cable attached at a proximal end to the waterproof switch;

a wire conductively attached at a proximal end to the waterproof switch;

a water-activated gas inflator mechanism including a gas inflation cartridge, attached to a distal end of the cable;

an inflatable balloon having an inflation opening, the inflation opening attached to the water-activated gas inflator mechanism; and a strobe light attached to the water-activated gas inflator mechanism, the strobe light further conductively attached to a proximal end of the wire;

deploying the life preserver locator system on the floatable life preserving aid into a body of water;

automatically activating the water-activated gas inflator mechanism on contact with the water;

automatically inflating the inflatable balloon by the water-activated gas inflator mechanism with gas from the gas inflation cartridge;

automatically activating the strobe light to emit light of a first light type; and automatically deploying the balloon into the air from the interior space of the water permeable envelope such that the balloon is suspended in the air and attached to the life preserver locator system by the cable.

12. The method of claim 11 wherein the water-activated gas inflator mechanism is saltwater activated and the water is saltwater.

13. The method of claim 11 wherein the inflatable balloon is an industrial-grade inflatable balloon.

14. The method of claim 11 wherein the gas inflation cartridge is a helium gas inflation cartridge.

15. The method of claim 11 further comprising:

manually activating the waterproof switch; and sending a signal from the waterproof switch over the wire to the strobe light changing the appearance of the emitted light from the first light type to a second light type.

* * * * *